US011304462B2

(12) United States Patent
Rabin et al.

(10) Patent No.: US 11,304,462 B2
(45) Date of Patent: Apr. 19, 2022

(54) MEDICAL GOWN

(71) Applicant: THE FEINSTEIN INSTITUTE FOR MEDICAL RESEARCH, Manhasset, NY (US)

(72) Inventors: Jill Maura Rabin, New York, NY (US); Alice Brody, New York, NY (US)

(73) Assignee: The Feinstein Institutes for Medical Research, Manhasset, NY (US)

( * ) Notice: Subject to any disclaimer, the term of this patent is extended or adjusted under 35 U.S.C. 154(b) by 0 days.

(21) Appl. No.: 15/599,945

(22) Filed: May 19, 2017

(65) Prior Publication Data

US 2017/0332711 A1 Nov. 23, 2017

Related U.S. Application Data

(60) Provisional application No. 62/339,186, filed on May 20, 2016.

(51) Int. Cl.
*A41D 13/12* (2006.01)

(52) U.S. Cl.
CPC ..... *A41D 13/1263* (2013.01); *A41D 13/129* (2013.01)

(58) Field of Classification Search
CPC .. A41D 13/1263; A41D 13/129; A41D 11/00; A41D 10/00
USPC ..... 2/128, 70, 71, 72
See application file for complete search history.

(56) References Cited

U.S. PATENT DOCUMENTS 1,696,714 A * 12/1928 Heller ..... A41D 7/00 2/79
3,179,955 A * 4/1965 Worth ..... A41D 1/00 2/114
3,852,824 A * 12/1974 Grey ..... A41D 13/02 2/79
4,103,377 A * 8/1978 Mayer ..... A41D 15/04 2/69.5
4,158,892 A * 6/1979 Gonzales ..... A41D 10/00 2/69.5
4,507,805 A * 4/1985 Calutoiu ..... A41D 10/00 2/69.5
4,718,122 A * 1/1988 Steverson ..... A41D 15/02 2/70
6,018,830 A * 2/2000 Howe ..... A47G 9/086 2/69.5

(Continued)

*Primary Examiner* — Alissa J Tompkins
*Assistant Examiner* — Brieanna Szafran
(74) *Attorney, Agent, or Firm* — Amster, Rothstein & Ebenstein LLP

(57) ABSTRACT

A hospital gown including an upper body portion and a lower body portion. The upper body portion includes a neck opening, a front opening extending vertically along the upper body portion and in communication with the neck opening, and a series of complementary closures disposed vertically along the front opening so that the front opening is configured to transition between an open condition and a closed condition. The lower body portion includes a pair of legs extending downwardly from the upper body portion, an opening extending vertically along the inseam of each leg of the pair of legs, and a series of complementary closures disposed vertically along each opening such that each opening is configured to transition between an open condition and a closed condition.

11 Claims, 7 Drawing Sheets

(56) References Cited

U.S. PATENT DOCUMENTS

| | | | | |
|---|---|---|---|---|
| 6,567,989 | B1 * | 5/2003 | Martinez | A41D 13/00 2/211 |
| 7,900,301 | B2 * | 3/2011 | Tatsuno | A47G 9/086 5/413 R |
| 2006/0156450 | A1 * | 7/2006 | McGrath | A41D 10/00 2/114 |
| 2008/0083049 | A1 * | 4/2008 | McLeod | A41D 13/1263 2/83 |
| 2014/0366239 | A1 * | 12/2014 | Biller | A41D 3/00 2/69.5 |

* cited by examiner

MEDICAL GOWN

FIELD OF INVENTION

The present invention generally relates to medical gowns to be worn by medical patients, that provides both ample and comfortable covering for the wearer's body and convenient access for a medical professional or caretaker to examine or treat the patient.

BACKGROUND

Conventional hospital gowns are provided to medical patients who are, for example, preparing for, undergoing, or recovering from a medical procedure, undergoing examination, or otherwise under observation. Such hospital gowns provide some measure of coverage for the wearer's body, but are also designed for ease of access to the patient's body by medical professionals or caretakers in mind.

Accordingly, conventional hospital gowns may feature loose openings or flaps that can leave portions of a patient's body exposed and may be designed primarily for minimal securement to a wearer's body so that removal can be expedited.

While these current designs serve a purpose, the psychological impact of inadequate attire can negatively affect a patient by, for example, inducing a feeling of lack of dignity or self-esteem. This may be especially true in situations in which the patient is already occupied with a medical condition. For example, antepartum mothers undergoing examination, delivering mothers coping with a medical condition such as diabetes or hypertension, or postpartum mothers beginning to breastfeed may be negatively affected by attire that, while functional, fails to provide adequate coverage for their bodies. Conventional medical gowns also do not provide adequate physical comfort. For example, the minimal covering offered by such gowns are not conductive to the patient feeling warm and secure while in a hospital environment.

In this regard, there is a need for attire for medical patients that provides both ample covering for the wearer as well as adequate access by medical professionals or caretakers.

SUMMARY

An object of the present invention is to provide a medical gown that provides accessible openings for medical professionals and caretakers while providing ample covering for the wearer.

A hospital gown according to an exemplary embodiment of the present invention comprises: an upper body portion comprising: a neck opening; a front opening extending vertically along the upper body portion and in communication with the neck opening; and a series of complementary closures disposed vertically along the front opening so that the front opening is configured to transition between an open condition and a closed condition; and a lower body portion comprising: a pair of legs extending downwardly from the upper body portion; an opening extending vertically along the inseam of each leg of the pair of legs; and a series of complementary closures disposed vertically along each opening such that each opening is configured to transition between an open condition and a closed condition.

According to an exemplary embodiment, each opening of the lower body portion extends partially along each respective inseam.

According to an exemplary embodiment, each opening of the lower body portion extends completely along each respective inseam.

According to an exemplary embodiment, the upper body portion further comprises sleeves.

According to an exemplary embodiment, the upper body portion further comprises a drawstring configured to adjust a size of the neck opening.

According to an exemplary embodiment, the upper body portion and the lower body portion are joined with one another so as to form a unitary garment.

According to an exemplary embodiment, the upper body portion and the lower body portion are separable from one another.

According to an exemplary embodiment, the upper body portion further comprises a stretchable member extending around a portion thereof.

According to an exemplary embodiment, the lower body portion further comprises a stretchable waistband.

According to an exemplary embodiment, the closures of at least one of the upper body portion or the lower body portion are comprised of complementary snaps.

According to an exemplary embodiment, the complementary closures of one opening of the lower body portion comprise a first series of female snap closure portions and a first series of male snap closure portions, and the complementary closures of the other opening of the lower body portion comprise a second series of male snap closure portions and a second series of female snap closure portions.

According to an exemplary embodiment, the first series of female snap closure portions and the second series of male snap closure portions are fastenable to one another, and the first series of male snap closure portions and the second series of female snap closure portions are fastenable to one another, so that the lower body portion is transformable between a pant configuration and a skirt configuration.

According to an exemplary embodiment, the closures of at least one of the upper body portion or the lower body portion are selected from the group consisting of: snaps, a button and slit, a zipper and zipper track, hook-and-loop fasteners, adhesive sections, buckles and draw strings.

According to an exemplary embodiment, at least one of the upper body portion or the lower body portion is comprised of a material selected from the group consisting of: wool, cotton, silk, linen, plant fiber, nylon, spandex, rayon, polyester, acrylic and blends thereof.

According to an exemplary embodiment, at least the upper body portion is sized such that the medical gown has a reversible orientation.

According to an exemplary embodiment, the upper body portion further comprises an opening disposed on a back of the medical gown.

BRIEF DESCRIPTION OF THE DRAWINGS

Various exemplary embodiments of this invention will be described in detail, with reference to the following figures, wherein.

DETAILED DESCRIPTION

As described herein, the term "wearer" may refer to a male or female person that wears medical gowns or garments described herein, and may indicate a person that is preparing for, undergoing, or recovering from a medical procedure or is otherwise under medical examination, observation, or supervision. As described herein, the terms "medical professional" and "caretaker" may refer to, for example, doctors, nurses, physicians assistants, nurse practitioners, midwives, medical facility staffers, non-professional caretakers, and, in some cases, the wearer himself or herself.

Figure 1:
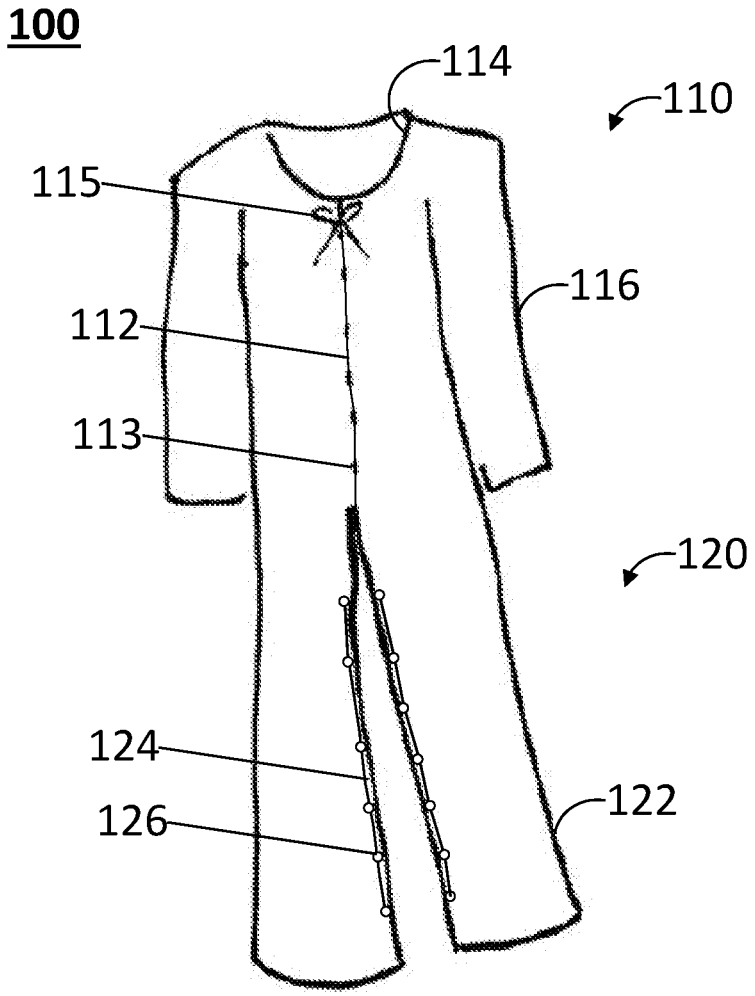
FIG. 1 is a front view of a medical gown according to an exemplary embodiment of the present invention in a closed configuration.

Referring to FIG. 1, an exemplary embodiment of a medical gown 100 is shown. Medical gown 100 defines an interior to receive portions of a wearer's body and includes an upper body portion 110 and a lower body portion 120. Medical gown 100 may be formed of natural and/or synthetic fabrics that include, but are not limited to: wool, cotton, silk, linen, plant fiber, nylon, spandex, rayon, polyester, acrylic, and blends thereof. Medical gown 100 may be formed of a material with particular properties such as, for example, fluid absorption, fluid resistance, or anti-microbial properties, to name a few.

Upper body portion 110 includes a front opening 112 between portions of medical gown 100 that are maintained in a closed configuration through a series of closures 113 disposed vertically along the front opening 112. As described herein, closures 113 may be in the form of snaps, however, in embodiments, closures 113 may be in a different form, for example, a button and slit, a zipper and zipper track, hook-and-loop fasteners, adhesive sections, a buckle configuration, a toggle configuration, or strings that may be tied, to name a few.

Front opening 112 extends from a lower location on upper body portion 110 (e.g., from the crotch of the gown 100 or from a point located vertically above the crotch) upwardly toward a neck opening 114 through which a wearer's neck can be disposed. In embodiments, there may optionally be an opening 117 located on the back of medical gown 100 that is similar to front opening 112, along with corresponding closures (e.g., snaps, buttons and slits, zipper, etc,). A drawstring 115 or other tensioning cord may be provided surrounding neck opening 114 to adjust a size of the neck opening 114, as described further herein. A pair of sleeves 116, e.g., tubular lengths of material, extend from the upper body portion 110 and are sized to at least partially receive a wearer's arms.

Sleeves 116 may be provided at lengths corresponding to approximate locations on a wearer's arm, for example, mid-arm (as in short-sleeved) or at the wearer's wrist (as in long-sleeved). In embodiments, medical gown 100 may be provided without sleeves 116, for example, in heated environments and/or environments in which it is desirable for a wearer's arms to be exposed. In embodiments, one or both sleeves 116 may be removable.

Lower body portion 120 extends downwardly from the upper body portion 110 and includes a pair of downwardly-extending legs 122 sized to at least partially receive a wearer's legs. Legs 122 may be provided at lengths corresponding to approximate locations on a wearer's legs, for example, thigh-length, knee-length, calf-length, or ankle-length. In embodiments, legs 122 may incorporate portions to receive a user's feet, for example, socks or boots.

Legs 122 are provided with leg openings 124 along their respective inseams. Leg openings 124 may extend downwardly along the inseam of the respective legs 122, for example, about 18 inches, about 19 inches, about 20 inches, about 21 inches, about 22 inches, about 23 inches, about 24 inches, about 25 inches, or about 26 inches, to name a few. In embodiments, leg openings 124 may extend completely down the respective inseams of legs 122, as described further herein. In embodiments, a single opening may extend between the inseams of both legs 122.

A series of closures 126 are provided vertically along leg openings 124 to maintain leg openings 124 in a closed condition. As described herein, closures 126 may be in the form of snaps, however, in embodiments, closures 126 may be in a different form, for example, a button and slit, a zipper and zipper track, hook-and-loop fasteners, adhesive sections, a buckle or toggle configuration, or strings that may be tied, to name a few.

In embodiments, lower body portion 120 may also incorporate a stretchable member, for example, an elastic band, to account for fit of the medical gown 100 to the midsection of the wearer's body. In embodiments, sleeves 116 and/or legs 122 may terminate in cuffs formed of a stretchable material.

Figure 2:
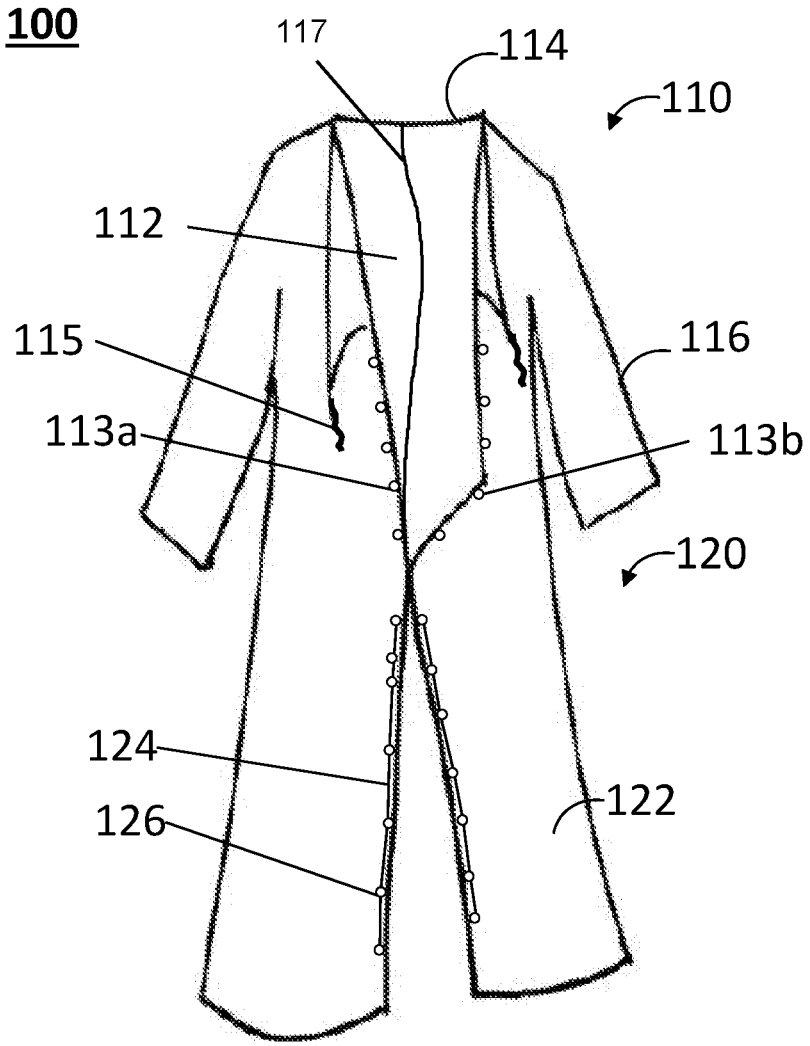
FIG. 2 is a front view of the medical gown of FIG. 1 in a partially open configuration.

Turning to FIG. 2, a wearer may access medical gown 100 by stepping through the neck opening 114 and/or front opening 112 into legs 122 and pulling the medical gown 100 upwardly such that the wearer can insert his or her arms into sleeves 116. In this regard, at least closures 113 should be in an open condition and drawstring 115 should be loosened prior to a wearer entering medical gown 100. At any point after entering the medical gown 100, the wearer may pull on drawstring 115 to cinch neck opening 114 about his or her neck to a comfortable fit and/or to provide adequate coverage of his or her body.

As shown, closures 113 include complementary closure parts 113*a* and 113*b*. One of closure parts 113*a*, 113*b* may be a male part including one or more protruding portions and the other of closure parts 113*a*, 113*b* may be a female closure part including one or more recesses for receiving the protruding portions of the male closure part and which are receivable in one or more recesses of the female closure part. In some embodiments, closures 113 may be universal members, e.g., having closure parts with both male and female features.

Figure 3:
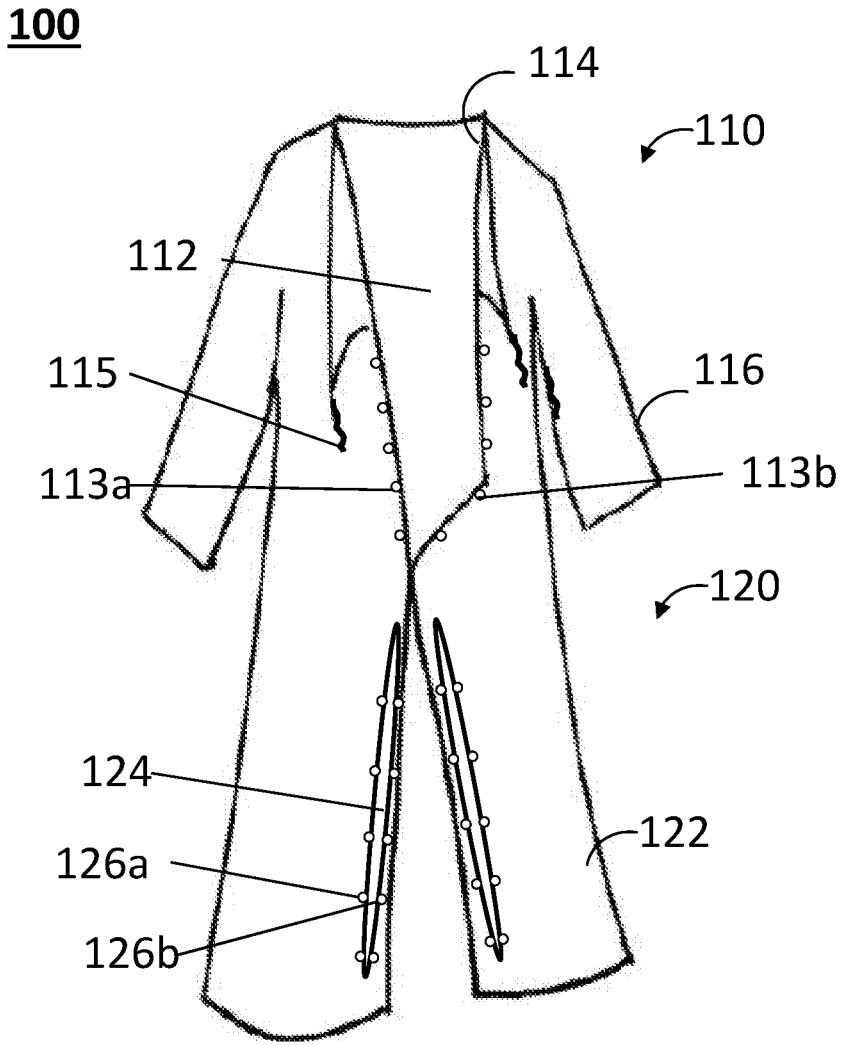
FIG. 3 is a front view of the medical gown of FIG. 1 in an open configuration.

Referring to FIG. 3, medical gown 100 is shown with closures 113 and 126 in an open condition such that openings 112 and 124 are accessible. Like closures 113 described above, closures 126 include closure parts 126*a*, 126*b* that may include male and female features. In embodiments, closures 126 may be universal, as described further herein.

Access through front opening 112 permits ease of access to an upper portion of a wearer's body by a medical professional or caretaker, for example, for clinical exams or to change dressings. Additionally, front opening 112 allows access by the wearer to the upper portion of his or her own body, for example, for comfort or for breastfeeding. In embodiments, front opening 112 may be only partially opened by the selective use of closures 113. In this regard, only a desired portion of front opening 112 can be used, while the remainder of front opening 112 is maintained in a closed condition. Once the relevant access to the wearer's body is no longer needed, front opening 112 can be closed so that the wearer again has full coverage of his or her body by the hospital gown 100.

In embodiments, medical gown 100 may be disposed on a wearer in a reverse orientation to that described above, e.g., with front opening 112 disposed along the back of the wearer. In this orientation, front opening 112 can be used to access back and/or side-facing portions of the wearer's body, if needed. Accordingly, medical gown 100 may be sized to have a reversible configuration.

Meanwhile, the leg openings 124 in legs 122 permit ease of access to a lower portion of a wearer's body by a medical processional or caretaker, for example, for clinical exams of the perineal region, gynecological exams, or proctological exams, to name a few. In embodiments, leg openings 124 may be only partially opened by the selective use of closures 126. For example, an upper portion of a wearer's leg may be accessed while the lower portion of the wearer's leg remains covered with the leg opening 124 in a closed condition or vice versa. Once the relevant access to the wearer's body is no longer needed, leg opening 124 can be closed so that the wearer again has full coverage of his or her body by the hospital gown 100.

In this regard, openings 112 and 124 can be selectively opened and closed along portions thereof only when access to portion of the wearer's body is necessary or desired, and can be closed thereafter. Accordingly, the wearer is provided with increased privacy as compared to conventional hospital gowns.

Figure 4:
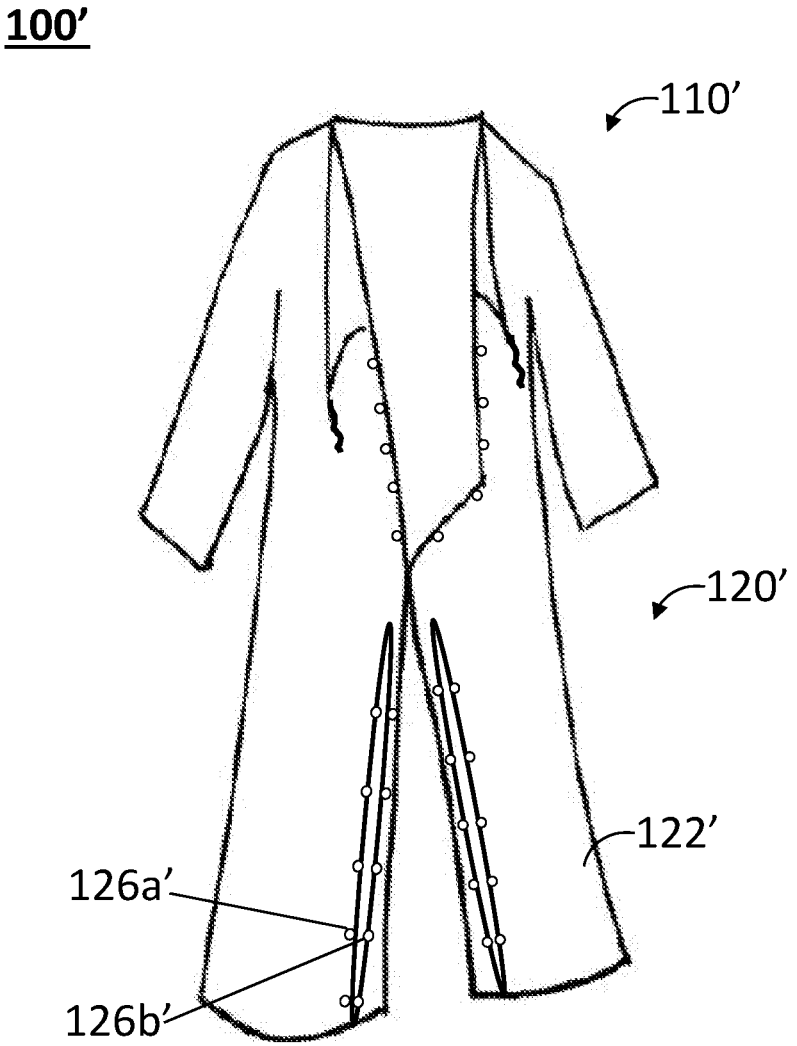
FIG. 4 is a front view of the medical gown of FIG. 1 according to an alternative embodiment of the present invention in an open configuration.

Turning to FIG. 4, an alternative embodiment of medical gown 100 is provided and is generally designated 100'. Medical gown 100' includes similar features to medical gown 100, and like components will be described with like reference numerals.

Medical gown 100' includes upper body portion 110' and lower body portion 120'. Lower body portion 120' is substantially similar to lower body portion 120, but has closure parts 126*a*', 126*b*' extending fully down the length of legs 122'. Closure parts 126*a*' 126*b*' join to form closures 126' and are universal members, e.g., having both male and female features, such that closure parts 126*a*' of one leg 122' are compatible with closure parts 126*a*' from the other leg 122'. Similarly, closure parts 126*b*' of one leg 122' are compatible with closure parts 126*b*' from the other leg 122'. Closures 126' may be in the form of snaps, however, in embodiments, closures 126' may be in a different form, for example, a button and slit, a zipper and zipper track, hook-and-loop fasteners, adhesive sections, a buckle or a toggle configuration, or strings that may be tied, to name a few.

Figure 5:
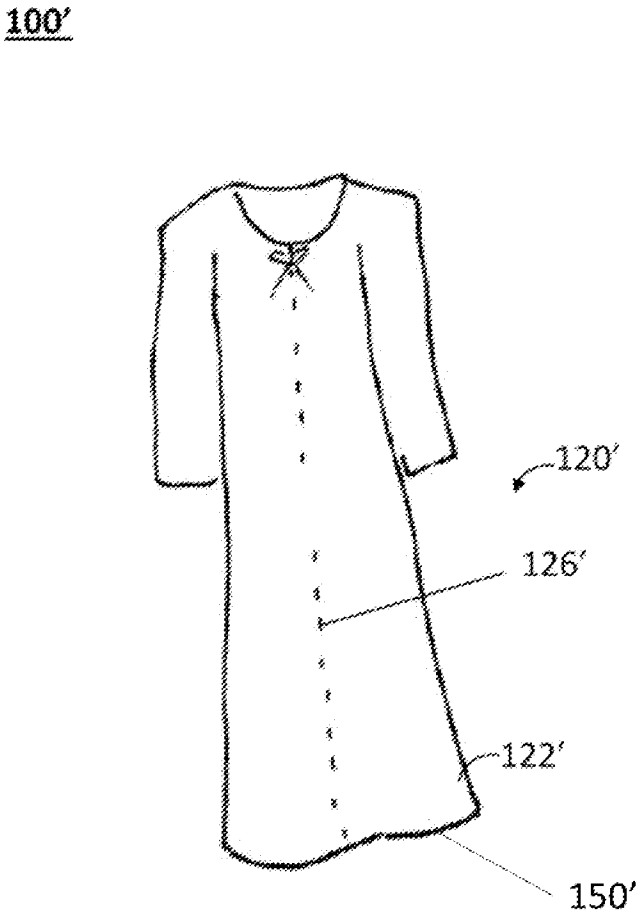
FIG. 5 is a front view of the medical gown of FIG. 4 in a closed configuration.

In this regard, and referring additionally to FIG. 5, closures 126' can be separated and rearranged such that respective closure parts 126*a*', 126*b*' of each leg 122' are joined to one another such that legs 122' have the form of a unitary skirt rather than paired legs. This results in a single circumferential opening 150' at the distal end of the lower body portion 120' so that when the lower body portion 120' is in the skirt configuration both legs of a wearer extend through and are exposed below the single circumferential opening 150'. Such a configuration may be desirable, for example, for patients that may be uncomfortable wearing pants for physiological or cultural reasons.

In an exemplary embodiment, for one leg 122', the closure part 126*a*' includes a female feature and the closure part 126*b*' includes a male feature, while for the other leg 122', the closure part 126*a*' includes a male feature and the closure part 126*b*' includes a female features. This arrangement allows for attachment of the closure parts 126*a*', 126*b*' of one leg 122' to be attached to the corresponding closure parts 126'*a*, 126*b*' of the other leg 122' to form a skirt-type garment.

Figure 6:
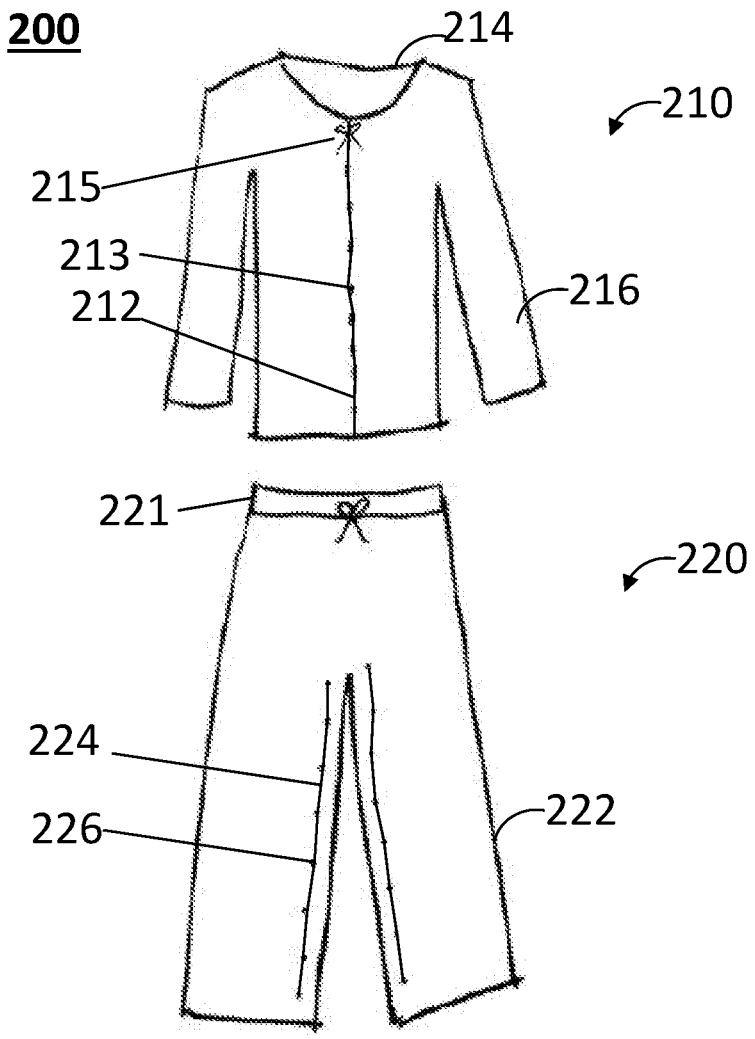
FIG. 6 is a front view of a medical gown according to another exemplary embodiment of the present invention in a closed configuration.

Turning to FIG. 6, a medical gown according to another exemplary embodiment of the present invention is generally designated 200. Medical gown 200 may be formed of natural and/or synthetic fabrics that include, but are not limited to: wool, cotton, silk, linen, plant fiber, nylon, spandex, rayon, polyester, acrylic, and blends thereof.

Medical gown 200 includes an upper body portion 210 and a lower body portion 220 each defining an interior to receive a portion of a wearer's body. As shown, upper body portion 210 and lower body portion 220 are separate from one another. In this regard, the upper body portion 210 of medical gown 200 may be in the form of a shirt, tunic, or nightdress and the lower body portion 220 of medical gown 200 may be in the form of pants or a tunic. In embodiments, upper body portion 210 and lower body portion 220 may incorporate couplings to join to one another. Medical gown 200 has some similar features to medical gown 100 described above, and like components will be described with like reference numbers.

Upper body portion 210 includes a front opening 212 between portions of medical gown 200. Portions of upper body portion 210 surrounding front opening 212 are maintained in a closed configuration through a series of closures 213 disposed vertically along front opening 112. As described herein, closures 213 may be in the form of snaps; however, in embodiments, closures 213 may be in a different form, for example, a button and slit, a zipper and zipper track, hook-and-loop closures, adhesive sections, a buckle or toggle configuration, or strings that may be tied, to name a few. In embodiments, there may optionally be located an opening located on the back of medical gown 200 that is similar to front opening 212, along with corresponding closures.

Front opening 212 extends from a lower location on upper body portion upwardly toward a neck opening 214 through which a wearer's neck can be disposed. A drawstring 215 may be provided surrounding neck opening 214 to adjust a size of the neck opening 214. A pair of sleeves 216, e.g., tubular lengths of material, extend from the upper body portion 210 and are sized to at least partially receive a wearer's arms.

Sleeves 216 may be provided at lengths corresponding to approximate locations on a wearer's arm, for example, mid-arm (as in short-sleeved) or at the wearer's wrist (as in long-sleeved). In embodiments, medical gown 200 may be provided without sleeves 216, for example, in heated environments and/or environments in which it is desirable for a wearer's arms to be exposed.

A lower end of upper body portion 210 may be provided with a fitting member, for example, an elastic band, drawstring, or other tensioning cord to at least partially maintain upper body portion 210 in position about the wearer. In embodiments, upper body portion 210 may be of sufficient length to extend to portions of a wearer's lower body such that lower body portion 220 is unnecessary or redundant, for example, in the case of a long tunic or robe.

Lower body portion 220 includes a stretchable waistband 221 that includes, for example, elastic or another stretchable material. In embodiments, waistband 221 may incorporate a drawstring or other tensioning cord.

As shown, a pair of legs 222 extend downwardly from the waistband 221 and at least partially receive a wearer's legs. Legs 222 may be provided at lengths corresponding to approximate locations on a wearer's legs, for example, at thigh-length, at knee-length, at calf-length, or at ankle-length. In embodiments, legs 222 may incorporate portions to receive a user's feet, for example, socks or boots.

Legs 222 are provided with leg openings 224 along their respective inseams formed by spaces between portions of legs 222. Leg openings 224 may extend downwardly along the inseam of the respective legs 222, for example, about 18 inches, about 19 inches, about 20 inches, about 21 inches, about 22 inches, about 23 inches, about 24 inches, about 25 inches, or about 26 inches, to name a few. In embodiments, a single opening may extend between the inseams of both legs 222. In embodiments, leg openings 224 may extend completely down the respective inseams of legs 222, as described above with respect to medical gown 100'.

A series of closures 226 are provided vertically along leg openings 224 to maintain leg openings 224 in a closed condition. As described herein, closures 226 may be in the form of snaps, however, in embodiments, closures 226 may be in a different form, for example, a button and slit, a zipper and zipper track, hook-and-loop closures, adhesive sections, a buckle configuration, or strings that may be tied, to name a few.

Figure 7:
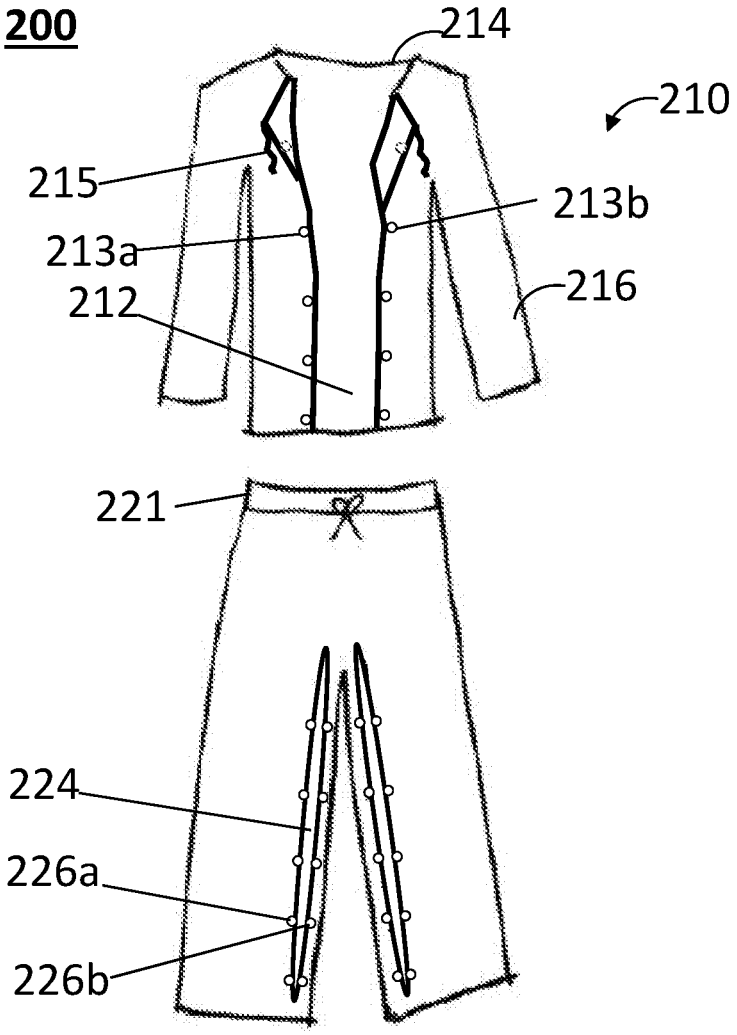
FIG. 7 is a front view of the medical gown of FIG. 6 in an open configuration.

Referring to FIG. 7, medical gown 200 is shown with closures 213 and 226 in an open condition such that openings 212 and 224 are accessible. Closures 213 and 226 each have respective complementary closure parts 213*a*, 213*b* and 226*a*, 226*b*. One of closure parts 213*a*, 213*b* and 226*a*, 226*b* may be a male part including one or more protruding portions and the other of closure parts 213*a*, 213*b* and 226*a*, 226*b* may be a female closure part including one or more recesses for receiving the protruding portions of the male closure part. and which are receivable in one or more recesses of the female closure part. In some embodiments, closures 213 and/or 224 may be universal members, e.g., having closure parts with both male and female features.

In embodiments where closures 226 have a universal configuration and extend fully along legs 222, lower body portion 220 may be convertible between pants and a skirt as described with respect to medical gown 100' above.

Front opening 212 permits ease of access to an upper portion of a wearer's body by a medical professional or caretaker, for example, for clinical exams or to change dressings. Additionally, front opening 212 allows access by the wearer to the upper portion of his or her own body, for example, for comfort or for breastfeeding. In embodiments, front opening 212 may be only partially opened by the selective use of closures 213. In this regard, only a desired portion of front opening 212 is used, while the remainder of front opening 212 is maintained in a closed condition. Once the relevant access to the wearer's body is no longer needed, front opening 212 can be closed so that the wearer again has full coverage of his or her body by the hospital gown 200.

In embodiments, medical gown 200 may be disposed on a wearer in a reverse orientation to that described above, e.g., with front opening 212 disposed along the back of the wearer. In this orientation, front opening 212 can be used to access back and/or side-facing portions of the wearer's body, if needed. Accordingly, medical gown 200 may be sized to have a reversible configuration.

Meanwhile, access through leg openings 224 permit ease of access to a lower portion of a wearer's body by a medical processional or caretaker, for example, for clinical exams of the perineal region, gynecological exams, or proctological exams, to name a few. In embodiments, leg openings 224 may be only partially opened by the selective use of closures 226. For example, an upper portion of a wearer's leg may be accessed while the lower portion of the wearer's leg remains covered with the leg opening 224 in a closed condition. Once the relevant access to the wearer's body is no longer needed, leg opening 224 can be closed so that the wearer again has full coverage of his or her body along hospital gown 200.

In this regard, openings 212 and 224 can be selectively opened and closed along portions thereof only when access to portion of the wearer's body is necessary or desired, and can be closed thereafter. Accordingly, the wearer is provided with increased privacy as compared to conventional hospital gowns.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

The invention claimed is:

1. A medical gown comprising:

an upper body portion comprising:

a neck opening;

a front opening extending vertically along the upper body portion and in communication with the neck opening, the front opening disposed at an anterior location relative to a wearer of the medical gown and extending upwardly toward the neck opening from an end point of the front opening positioned vertically above a crotch portion of the medical gown;

a series of complementary closures disposed vertically along the front opening so that the front opening is configured to transition between an open condition and a closed condition;

a back opening extending vertically along the upper body portion, the back opening disposed at a posterior location relative to the wearer that is opposite to the anterior location; and a series of complementary closures disposed vertically along the back opening so that the back opening is configured to transition between an open condition and a closed condition; and a lower body portion comprising:

a distal end;

a pair of legs extending downwardly from the upper body portion to the distal end;

an opening extending vertically along an inseam of each leg of the pair of legs, each of the openings in the lower body portion extending downwardly from an end point of the opening positioned vertically below the crotch portion to a bottom of the inseam of the corresponding leg at the distal end; and a series of complementary closures disposed vertically along each opening to the distal end such that each opening is configured to transition between an open condition and a closed condition, wherein:

the complementary closures of one opening of the lower body portion comprise a first series of female closure portions and a first series of male closure portions, and the complementary closures of the other opening of the lower body portion comprise a second series of male closure portions and a second series of female closure portions, the lower body portion is transformable between a pant configuration and a skirt configuration, in the skirt configuration, the first series of female closure portions and the second series of male closure portions are fastened to one another, and the first series of male closure portions and the second series of female closure portions are fastened to one another, so that the pair of legs are configured to form a single circumferential opening at the distal end of the lower body portion so that when the lower body portion is in the skirt configuration both legs of a wearer extend through and are exposed below the single circumferential opening, and the crotch portion is made up of material that extends between the end point of the front opening and the end points of the openings in the lower body portion so that the medical gown remains intact at the crotch portion when the front opening, the back opening and the openings in the lower body portion are in the open condition.

2. The medical gown of claim 1, wherein the upper body portion further comprises sleeves.

3. The medical gown of claim 1, wherein the upper body portion further comprises a drawstring configured to adjust a size of the neck opening.

4. The medical gown of claim 1, wherein the upper body portion and the lower body portion are joined with one another so as to form a unitary garment.

5. The medical gown of claim 1, wherein the upper body portion further comprises a stretchable member extending around a portion thereof.

6. The medical gown of claim 1, wherein the lower body portion further comprises a stretchable waistband.

7. The medical gown of claim 1, wherein the closures of at least one of the upper body portion or the lower body portion are comprised of complementary snaps.

8. The medical gown of claim 1, wherein the closures of at least one of the upper body portion or the lower body portion are selected from the group consisting of: snaps, a button and slit, a zipper and zipper track, hook-and-loop fasteners, adhesive sections, buckles and draw-strings.

9. The medical gown of claim 1, wherein at least one of the upper body portion or the lower body portion is comprised of a material selected from the group consisting of: wool, cotton, silk, linen, plant fiber, nylon, spandex, rayon, polyester, acrylic and blends thereof.

10. The medical gown of claim 1, wherein at least the upper body portion is sized such that the medical gown has a reversible orientation.

11. The medical gown of claim 1, wherein, in the pant configuration, the first series of female closure portions and the first series of male closure portions are fastened to one another, and the second series of male closure portions and the second series of female closure portions are fastened to one another.

* * * * *